US007866581B2

(12) United States Patent
Omatsu et al.

(10) Patent No.: US 7,866,581 B2
(45) Date of Patent: Jan. 11, 2011

(54) METHOD OF MANUFACTURING TONER

(75) Inventors: Schinichirou Omatsu, Wakayama (JP); Toshihiro Hattori, Wakayama (JP)

(73) Assignee: Kao Corporation, Tokyo (JP)

( * ) Notice: Subject to any disclaimer, the term of this patent is extended or adjusted under 35 U.S.C. 154(b) by 581 days.

(21) Appl. No.: 10/588,974

(22) PCT Filed: Feb. 10, 2004

(86) PCT No.: PCT/JP2004/001370

§ 371 (c)(1),
(2), (4) Date: Aug. 10, 2006

(87) PCT Pub. No.: WO2005/076085

PCT Pub. Date: Aug. 18, 2005

(65) Prior Publication Data

US 2008/0283638 A1 Nov. 20, 2008

(51) Int. Cl.
*B02C 19/06* (2006.01)
*B02C 23/08* (2006.01)

(52) U.S. Cl. ..... 241/5; 241/40

(58) Field of Classification Search ..... 241/5, 241/40

See application file for complete search history.

(56) References Cited

U.S. PATENT DOCUMENTS

| | | | | |
|---|---|---|---|---|
| 5,133,504 | A * | 7/1992 | Smith et al. | 241/5 |
| 5,435,496 | A * | 7/1995 | Kanda et al. | 241/5 |
| 5,934,575 | A * | 8/1999 | Ohnishi et al. | 241/5 |
| 2005/0139701 | A1* | 6/2005 | Naka et al. | 241/5 |

FOREIGN PATENT DOCUMENTS

| | | |
|---|---|---|
| JP | 57-50554 | 3/1982 |
| JP | 58-143853 | 8/1983 |
| JP | 1-254266 | 10/1989 |
| JP | 01-317554 | 12/1989 |
| JP | 04-210255 | 7/1992 |
| JP | 4-271853 | 9/1992 |
| JP | 05-007842 | 1/1993 |
| JP | 06-194869 | 7/1994 |
| JP | 8-117633 | 5/1996 |
| JP | 9-206621 | 8/1997 |

(Continued)

*Primary Examiner*—Faye Francis
(74) *Attorney, Agent, or Firm*—Oblon, Spivak. McClelland, Maier & Neustadt, L.L.P.

(57) ABSTRACT

A process for preparing a toner including the step of pulverizing a resin composition with a jet type pulverizer comprising a venturi nozzle and an impact member arranged so as to face the venturi nozzle, wherein $r_2/r_1$ is 0.3 or less, wherein $r_1$ is a radius of the largest circle $R_1$ among the circles formed with 3 points including any given 2 points located on the outer circumference of the impact side of the above impact member, and one point located on a line connecting the 2 points in the shortest distance on the impact side; and $r_2$ is a radius of the largest circle $R_2$ among the circles formed with 3 points including 2 points located on an outer circumference of the impact side, intersecting with a line perpendicularly at a given point with the line connecting the 3 points forming the circle $R_1$, and one point located on a line connecting the 2 points in the shortest distance on the impact side; and a pulverization member and a jet type pulverizer, each being used in the process.

19 Claims, 4 Drawing Sheets

FOREIGN PATENT DOCUMENTS

| | | |
|---|---|---|
| JP | 10-202135 | 8/1998 |
| JP | 11-70341 | 3/1999 |
| JP | 2000-140675 | 5/2000 |
| JP | 2004-73918 | 3/2004 |
| JP | 2004-73918 A | 3/2004 |

* cited by examiner

METHOD OF MANUFACTURING TONER

TECHNICAL FIELD

The present invention relates to a process for preparing a toner used for developing a latent image formed in electrophotography, recording method, electrostatic printing method, or the like, and a pulverization member and a jet type pulverizer, each being used in the process.

BACKGROUND ART

In recent years, there has been an increasing demand for formation of a toner having a small particle size as well as high image quality. In general, in the formation of a toner having a small particle size, a process including the steps of jetting a jet air containing a powder raw material from a venturi nozzle, and pulverizing a powder raw material by an impact to an impact member, and further by a secondary impact to a wall surface has been carried out, and various studies have been made in the aim of improving pulverization efficiency. In connection to those relating to the shapes of the impact members, those that are arranged perpendicular to or slanted to the direction of the jet stream, having a flat shape (JP-A-Showa-57-50554 and JP-A-Showa-58-143853), a conical shape (JP-A-Hei-1-254266 and JP-A-Hei-11-70341), a spherical shape (JP-A-Hei-8-117633), and the like have been disclosed. On the other hand, as to the venturi nozzle, those having an improved shape in a throat part (JP 2000-140675 A) have been disclosed. However, in these conventional methods, a fine powder having an even smaller particle size than the desired particle size is generated in a large amount, thereby lowering production efficiency of the toner. Therefore, its improvement has been desired.

DISCLOSURE OF THE INVENTION

The present invention relates to a process for preparing a toner including the step of pulverizing a resin composition with a jet type pulverizer comprising a venturi nozzle and an impact member arranged so as to face the venturi nozzle, wherein $r_2/r_1$ is 0.3 or less, wherein $r_1$ is a radius of the largest circle $R_1$ among the circles formed with 3 points including any given 2 points located on the outer circumference of the impact side of the above impact member, and one point located on a line connecting the 2 points in the shortest distance on the impact side; and $r_2$ is a radius of the largest circle $R_2$ among the circles formed with 3 points including 2 points located on an outer circumference of the impact side, intersecting with a line perpendicularly at a given point with the line connecting the 3 points forming the circle $R_1$, and one point located on a line connecting the 2 points in the shortest distance on the impact side; and a pulverization member and a jet type pulverizer, each being used in the process.

BRIEF DESCRIPTION OF THE DRAWINGS

In FIG. 1, 1 is a venturi nozzle, 2 an impact member, 3 an inlet, 4 a throat part, 5 a diffuser part, 6 an outlet, and 7 a straight part.

In FIG. 2, 3 is an inlet, 4 a throat part, 5 a diffuser part, 6 an outlet, and 7 a straight part.

DETAILED DESCRIPTION OF THE INVENTION

Figure 1:
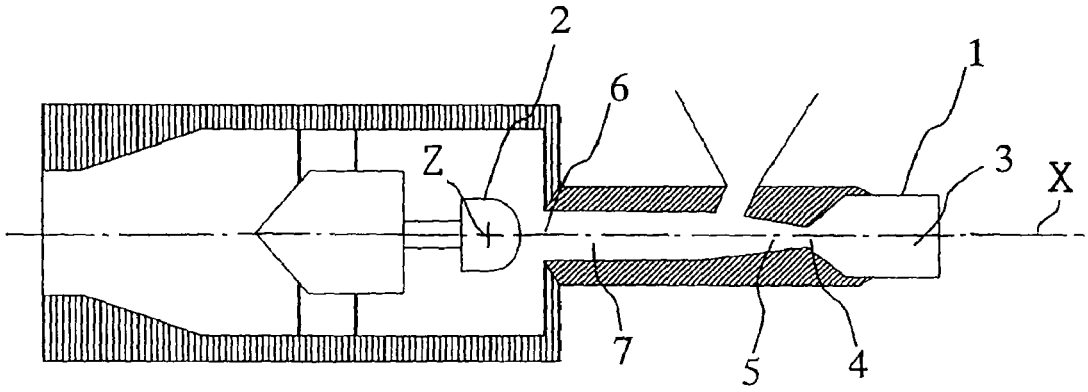
FIG. 1 is a schematic cross-sectional view showing one embodiment of a jet type pulverizer used in the present invention.

The present invention relates to a process capable of reducing the generation of fine powder upon pulverization of a resin composition, whereby a toner, and even a toner having a smaller particle size, can be efficiently prepared; and a pulverization member and a jet type pulverizer, each being used in the process.

The present inventors have considered that the above conventional techniques have been developed and designed for the purpose of carrying out a multi-step pulverization including a primary pulverization with an impact plate, and a further secondary pulverization with a wall surface, so that fine powder is likely to be generated, thereby making the production efficiency poor. Therefore, the present inventors have studied on a pulverization process of which main process is a primary pulverization with an impact plate, and production efficiency is high.

Specifically, in a conventional impact member of which impact side is made of a flat plate, the powder raw material is collided on the entire surface of the impact side. Therefore, while a high impact strength can be obtained, a fine powder pulverized by turbulence due to back pressure is less likely to be carried to an outlet, so that a powder concentration near the impact side would be high, thereby lowering the pulverization efficiency. In addition, in an impact member having a conical or spherical shape for the purpose of improving the disadvantage, since the portion of a high impact strength is concentrated to one point at the tip end, the primary pulverization efficiency is very low, while the fluidity of the fine powder is facilitated.

In view of the above, the present inventors have considered that the object of the present invention is accomplished if an impact member having its point of impact approximating to a linear shape, thereby increasing the pulverization efficiency, and having a shape so as to release back pressure efficiently, and studied. As a result, they have found that by using a jet type pulverizer having a venturi nozzle, and using an impact member having an impact side having a particular shape, the generation of a fine powder is suppressed, whereby a toner having a small particle size can be efficiently prepared. The present invention has been accomplished thereby.

The process for preparing a toner of the present invention is not particularly limited, as long as the process includes the pulverizing step using a jet type pulverizer mentioned below. For example, the process includes a process including the steps of melt-kneading a mixture prepared by mixing a resin binder, a colorant, or the like in a mixer such as a Henschel mixer in a closed type kneader, a twin-screw extruder, an open-roller type kneader or the like, and cooling the mixture, and the cooled resin composition obtained is then pulverized with a jet type pulverizer in the present invention.

The resin binder used in the present invention includes polyesters; vinyl resins such as styrene-acrylic resins; epoxy resins; polycarbonates; polyurethanes; a hybrid resin in which two or more kinds of resin components are partially chemically bonded to each other, and the like, without being particularly limited thereto. Among them, a polyester and a hybrid resin containing a polyester component and a vinyl resin component are preferable, and a polyester is more preferable. The amount of the polyester or the hybrid resin, or a total amount when the both are used together, is preferably from 50 to 100% by weight, more preferably from 80 to 100% by weight, and especially preferably 100% by weight, of the resin binder.

The polyester is obtained by polycondensation of raw materials containing as a main component a dihydric or higher polyhydric alcohol, and preferably a dihydric alcohol, with a carboxylic acid component containing as a main component a dicarboxylic or higher polycarboxylic acid compound, and preferably a dicarboxylic acid compound.

The dihydric alcohol includes an alkylene (2 or 3 carbon atoms) oxide (average number of moles: 1 to 10) adduct of bisphenol A, such as polyoxypropylene(2.2)-2,2-bis(4-hydroxyphenyl)propane and polyoxyethylene(2.2)-2,2-bis(4-hydroxyphenyl)propane; ethylene glycol, propylene glycol, 1,6-hexanediol, bisphenol A, and hydrogenated bisphenol A; and the like.

The dihydric alcohol is contained in an amount of preferably 50% by mol or more, more preferably from 80 to 100% by mol, and even more preferably 100% by mol, of the alcohol component.

The trihydric or higher polyhydric alcohol includes sorbitol, 1,4-sorbitan, pentaerythritol, glycerol, trimethylolpropane, and the like.

In addition, the dicarboxylic acid compound includes dicarboxylic acids such as phthalic acid, isophthalic acid, terephthalic acid, fumaric acid, and maleic acid; a substituted succinic acid of which substituent is an alkyl group or alkenyl group having 1 to 20 carbon atoms, acid anhydrides thereof, alkyl (1 to 12 carbon atoms) esters thereof, and the like.

The dicarboxylic acid compound is contained in an amount of preferably 50% by mol or more, more preferably from 80 to 100% by mol, and even more preferably 100% by mol, of the carboxylic acid component.

In addition, the tricarboxylic or higher polycarboxylic acid compound includes 1,2,4-benzenetricarboxylic acid (trimellitic acid); an acid anhydride thereof, alkyl (1 to 12 carbon atoms) esters thereof, and the like.

It is preferable that the trivalent or higher polyvalent raw material monomer is contained in an amount of 20% by mol or less of the entire raw material monomer. In addition, a monovalent raw material monomer may be used from the viewpoint of adjustment of molecular weight or the like.

The polyester can be prepared by, for example, polycondensation of the alcohol component and the carboxylic acid component at a temperature of from 180° to 250° C. in an inert gas atmosphere in the presence of an esterification catalyst as desired.

In addition, the polyester has a softening point of preferably from 80° to 165° C. and a glass transition temperature of preferably from 30° to 85° C., and more preferably from 50° to 70° C.

The polyester has an acid value of preferably from 0.5 to 60 mg KOH/g, from the viewpoint of dispersibility of the colorant, chargeability and durability, and the polyester has a hydroxyl value of preferably from 1 to 60 mg KOH/g.

In addition, in the present invention, a hybrid resin may be obtained by using two or more resins as raw materials, a hybrid resin may be obtained by using a mixture of one kind of resin and raw material monomers for the other resin, or a hybrid resin may be those obtained from a mixture of raw material monomers of two or more resins. In order to efficiently obtain a hybrid resin, those obtained from a mixture of raw material monomers of two or more resins are preferable.

Therefore, as the hybrid resin, a resin prepared by mixing raw material monomers of two polymerization resins each having an independent reaction pathway, and preferably raw material monomers of a polyester and raw material monomers of a vinyl resin, and carrying out two polymerization reactions is preferable. Specifically, those hybrid resins described in JP-A-Hei 10-087839 are preferable.

As the colorants usable in the present invention, all of the dyes, pigments, and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner prepared according to the present invention may be any of black toners, color toners, and full color toners. The colorant is contained in an amount of preferably from 1 to 40 parts by weight, and more preferably from 3 to 10 parts by weight, based on 100 parts by weight of the resin binder.

In the present invention, in addition to the resin binder and the colorant, additives such as releasing agents, charge control agents, fluidity improvers, electric conductivity modifiers, extenders, reinforcing fillers such as fibrous substances, antioxidants, anti-aging agents, cleanability improvers, and magnetic powder may be further contained as raw materials.

The releasing agent includes natural ester waxes such as carnauba wax and rice wax; synthetic waxes such as polypropylene wax, polyethylene wax and Fischer-Tropsch wax; coal waxes such as montan wax; alcohol waxes; and the like. The releasing agent is contained in an amount of preferably from 2 to 30 parts by weight, and more preferably from 5 to 20 parts by weight, based on 100 parts by weight of the resin binder.

A resin composition obtained by melt-kneading a mixture containing a resin binder, a colorant and the like, and thereafter cooling the mixture may be fed to a jet type pulverizer directly as a powder raw material. It is preferable that the resin composition obtained by previously pulverizing the mixture with a Rotoplex or an atomizer to a particle size of 3 mm or less or so, and mixing the pulverized product with inorganic fine particles is thereafter fed to the jet type pulverizer. Here, a particle size refers to a longest diameter of the particle.

The fine inorganic particles are preferably composed of, for example, an inorganic oxide such as silica, alumina, titania, zirconia, tin oxide and zinc oxide, and these can be used alone or in admixture of two or more kinds. Among them, silica is preferable from the viewpoint of formation of a smaller particle size of the toner and ensuring fluidity.

It is preferable that the silica is a hydrophobic silica that is subjected to a hydrophobic treatment, from the viewpoint of environmental stability or the like. The hydrophobic treatment method is not particularly limited. The hydrophobic treatment agent includes hexamethyl disilazane, dimethyl dichlorosilane, silicone oil and methyl triethoxysilane, and the like. Among them, hexamethyl disilazane is preferable. The amount treated by the hydrophobic treatment agent is preferably from 1 to 7 $mg/m^2$ per surface area of the fine inorganic particles.

It is desired that the fine inorganic particles have an average particle size of 0.001 μm or more, and preferably 0.005 μm or more, from the viewpoint of preventing embedment in the surface of the toner. It is desired that the fine inorganic particles have an average particle size of 1 μm or less, and preferably 0.1 μm or less, from the viewpoint of ensuring fluidity and preventing a photoconductor from being damaged. Therefore, the fine inorganic particles have an average particle size of preferably from 0.001 to 1 μm, and more preferably from 0.005 to 0.1 μm.

The resin composition and the fine inorganic particles can be mixed, for example, with a mixer that can be stirred at a fast speed, such as a Henschel mixer or a Supermixer.

The fine inorganic oxide particles is contained in an amount of preferably from 0.3 to 2 parts by weight, and more preferably from 0.5 to 1 part by weight, based on 100 parts by weight of the resin composition from the viewpoint of preventing melt fusion.

Next, a resin composition, or a mixture composed of a resin composition and fine inorganic particles is pulverized with a jet type pulverizer. One of the feature in the present invention resides in the structure of this jet type pulverizer. Specifically, the jet type pulverizer used in the present invention is a jet type pulverizer equipped with a venturi nozzle 1 and an impact member 2 arranged so as to face the venturi nozzle 1, as exemplified in the schematic cross-sectional view shown in FIG. 1.

Figure 2:
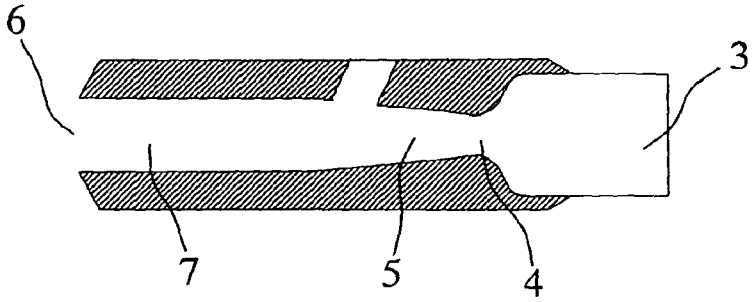
FIG. 2 is a schematic cross-sectional view showing one embodiment of a venturi nozzle preferably used in the present invention.

The venturi nozzle is a nozzle having a shape which is narrowed in the central part, in which the diameter of the nozzle tube is relatively dramatically decreased and then gradually expanded, the nozzle containing an inlet 3, a throat part 4, a diffuser part 5, and an outlet 6 in that order. A compressed gas introduced into the venturi nozzle 1 from the inlet 3 reaches its maximum rate at the throat part 4, and the high-speed gas stream thus produced thereby passing through the diffuser part 5 and colliding with the impact member. Therefore, the mixture fed into the nozzle from the feeding port for a product to be pulverized is transported along with the high-speed gas stream, and the transported mixture is finely pulverized by a large amount of an impact energy received on the impact member. It is preferable that the internal side of the throat part 4 in the venturi nozzle is in an arc shape smoothly and continuously connected from the inlet 3 to the diffuser part 5, as shown in FIG. 2. By using the venturi nozzle, the compressed gas is smoothly allowed to flow along the arc-shaped internal side, so that the loss of energy in the throat part 4 and the diffusion of energy in the diffuser part 5 are highly significantly and effectively suppressed, thereby enabling the mixture fed into the nozzle to collide with the impact member with a larger energy. The venturi nozzle can even more improve production efficiency together with the impact member of the present invention.

Furthermore, it is preferable that a straight part 7 on the outlet side of the diffuser part 5 is provided, so that the diffusion of energy is more suppressed, and that the product to be pulverized can be more finely pulverized with higher efficiency.

The venturi nozzle preferably used in the present invention includes, for example, a nozzle incorporated in a pulverizer described in JP2000-140675 A. Commercially available pulverizers having a venturi nozzle include, for example, "Impact Type Supersonic Jet Mill Model IDS-2" (manufactured by Nippon Pneumatic Mfg. Co., Ltd.), and the like.

The diameter of the outlet of the venturi nozzle depends upon the size of the impact type jet mill or the like. For example, in the above-mentioned "Impact Type Supersonic Jet Mill Model IDS-2", the outlet has a diameter of preferably from 10 to 15 mm or so.

The compressed gas introduced into the venturi nozzle includes air, nitrogen gas, and the like.

The pulverization pressure at the impact member by the high-speed gas stream formed with the compressed gas differs according to an average particle size of a desired toner, or the like. It is preferable that the pulverization pressure of the pulverizer is usually from 0.1 to 0.7 MPa or so.

The feeding rate of the product to be pulverized differs according to an average particle size of a desired toner, or the like. The feeding rate of the product to be pulverized is preferably from 0.5 to 10 kg/h, more preferably from 1 to 5 kg/h, and even more preferably 3 kg/h or so.

The pulverization force on the product to be pulverized which is fed to the impact type jet mill can be adjusted by the feeding amount of the product to be pulverized, the pulverization pressure, or the like.

The impact member in the present invention is preferably an impact member has a $r_2/r_1$ ratio of 0.3 or less, wherein $r_1$ is a radius of the largest circle $R_1$ among the circles formed with 3 points including any given 2 points located on the outer circumference of the impact side of the impact member and one point located on a line connecting the 2 points in the shortest distance on the impact side; and $r_2$ is a radius of the largest circle $R_2$ among the circles formed with 3 points including any 2 points located on an outer circumference of the impact side, intersecting with a line perpendicularly at a given point with the line connecting the 3 points forming the circle $R_1$, and one point located on a line connecting the 2 points in the shortest distance on the impact side.

In the present invention, the impact side is a side on which a resin composition is to be collided or allowed to flow, and can be visually seen at least from the direction of the venturi nozzle. Moreover, it is preferable that the impact side is a side in which the line connecting 3 points for forming the circle $R_1$ is not bent, so that the 3 points are connected with a smooth line. The impact side does not have any particular limitation on its shape. Preferably, the impact side has a smooth round side or a smooth curved side that does not contain any projections and dents.

Methods for obtaining the circles $R_1$ and $R_2$ will be specifically described hereinbelow.

First, any 2 points are set on the outer circumference of the impact side, to obtain a line connecting the 2 points in the shortest distance on the impact side (hereinafter referred to as line A). Next, any 1 point is set on the line A, to obtain a radius of a circle which passes through the point and the 2 points on the outer circumference of the impact side. This procedure is carried out at each point on the line A, to obtain a circle having the largest radius. Further, any other 2 points on the outer circumference of the impact side are used to obtain a circle giving the largest radius in the same manner as above, and the circle giving the largest radius is determined among all the circles obtained. This is the circle $R_1$. More understandably, the circle $R_1$ is determined for the purpose of selecting a straight line or a nearly straight line when viewed three-dimensionally, among the lines on the impact side.

Next, the circle $R_2$ is obtained. The purpose of obtaining the circle $R_2$ is to determine a straight line or a nearly straight line when viewed three-dimensionally, among the lines existing on the impact side orthogonal to the circle $R_1$. The circle $R_2$ can be obtained in the same manner as in the circle $R_1$ except for an additional condition that the line is orthogonal to the circle $R_1$. When each of the circles $R_1$ and $R_2$ exists in plurality, the circle closest to the center of gravity of the impact member when viewed three-dimensionally is selected.

As described above, the circles $R_1$ and $R_2$ are determined, so that their radii $r_1$ and $r_2$, and a ratio therebetween can be obtained. In the present invention, the ratio between $r_1$ and $r_2$, i.e., $r_2/r_1$, serves as a measure of the degree of curvature on the impact side.

In the present invention, each of $r_1$ and $r_2$ is a numerical value that is not "0." When the 3 points forming a circle are present on a straight line, the radius of the circle is infinite (∞). When the impact side is a planar surface, the $r_2/r_1$ ratio satisfies ∞/∞=1. In addition, when a line connecting the 3 points forming the circle $R_2$ on the impact side is a curve, and a line connecting the 3 points forming the circle $R_1$ on the impact side is a straight line, the $r_2/r_1$ ratio satisfies finite numerical value/∞=0.

Figure 3:
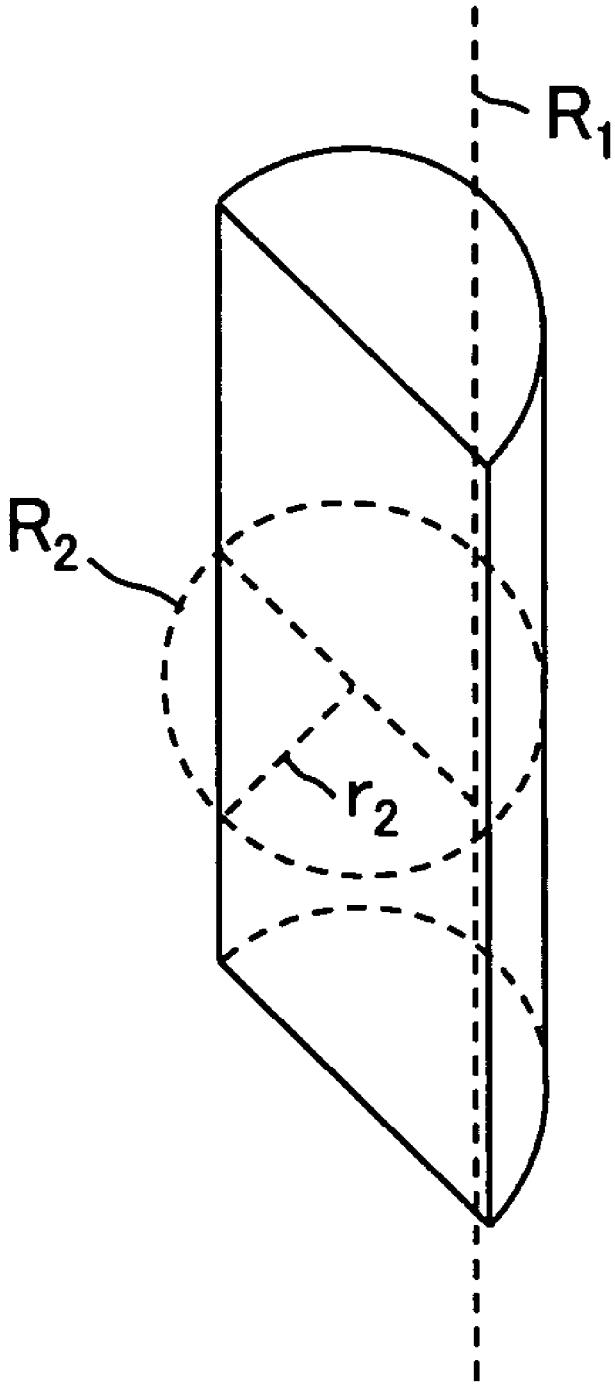
FIG. 3 is a schematic view showing a circle $R_1$; and a circle $R_2$ and a radius $r_2$ thereof in an impact member in the present invention.

Specifically, the closer the $r_2/r_1$ ratio to 1, the more it is shown that the impact side is in a symmetric form such as a spherical surface, a conical surface, a flat plate, or the like. On the other hand, the closer the $r_2/r_1$ ratio to 0, it is shown that the impact side is curved, and when the $r_2/r_1$ ratio is equal to 0, it is shown that the impact side is a side which is curved only in one direction of a flat plate. Circles $R_1$ and $R_2$, and a radius $r_2$ are shown in FIG. 3 in a case where the impact side is on a semi-cylindrical member containing a part of a true circle on its bottom side. In this case, the radius $r_1$ is infinite (∞).

The $r_2/r_1$ ratio is preferably 0.1 or less, more preferably 0.05 or less, even more preferably 0.001 or less, and especially preferably 0.

In a conventional process, a fine powder having an even smaller size than the desired particle size, for example, a size of 3 μm or less, is generated in a large amount, thereby lowering the production efficiency of the toner. In the present invention, by using an impact member having an impact side having a specified shape as described above, the generation of fine powder is markedly reduced. The smaller the degree of curving and the more the curve approximates a straight line, the more linear the impact point of a product to be pulverized; the larger the degree of curving, the smaller the turbulence due to back pressure, so that the pulverized fine powder is efficiently carried to an outlet. Therefore, by using the impact member of the present invention having an impact side combinably having both curves, it is presumed that the primary impact is a main one, so that the generation of unnecessary fine powder due to the secondary impact is suppressed.

The larger the radius $r_1$, the more favorable. The radius $r_1$ is preferably 10 d or more, more preferably 100 d or more, and even more preferably infinite (∞). Here, the phrase "$r_1$ is infinite" means that the line connecting 2 points forming a circle $R_1$ on the outer circumference of the impact side in the shortest distance as described above is a straight line, namely the line connecting the 3 points forming a circle $R_1$, is a straight line. It is preferable that the top part of the impact member, i.e., the most projected part of the impact side is located in the central part of the line connecting the 3 points forming the circle $R_2$ located on the outer circumference of the impact side. In addition, the most projected part of the impact side has a height of preferably from 0.2 $r_2$ to 3 $r_2$, and more preferably from 0.5 $r_2$ to 1.5 $r_2$.

The linear distance between the 2 points forming the circle $R_1$, located on the line on the outer circumference of the impact side is preferably from 2 d to 20 d, more preferably from 5 d to 15 d, and even more preferably from 7 d to 12 d.

When d is a radius of an opening in the outlet of the venturi nozzle, the linear distance between the 2 points forming the circle $R_2$, located on the line on the outer circumference of the impact side is preferably from 0.3 d to 2 d, more preferably from 0.7 d to 1.3 d, and even more preferably from 0.9 d to 1.2 d.

The impact member preferably used in the present invention includes an impact member of which impact side has at least a part of a cylindrical member having a true circle or an oval on its bottom side. The cylindrical member may have a little bulge in the central part. It is preferable that the cylindrical member does not have any bulge. Also, the shape and size of sides at both ends of the impact side may be identical or different. It is preferable that the sides at both ends have the same shape, and more preferably the same size.

Figure 4:
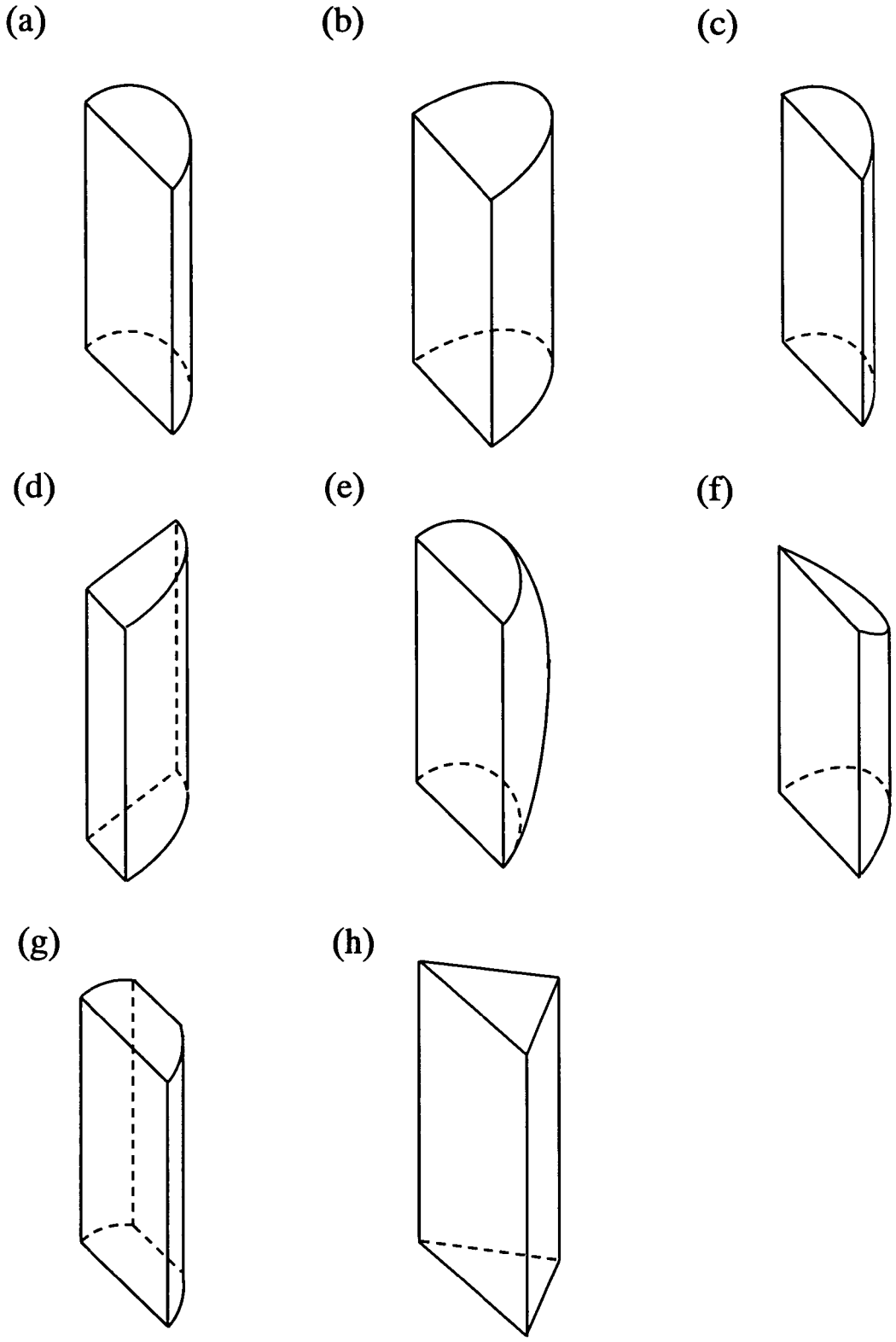
FIG. 4 is a schematic view showing an embodiment of an impact member used in the present invention.

In addition, the impact member of which impact side has at least a part of the cylindrical member, is not limited to the cylindrical member itself, and includes one obtained by properly dividing the cylindrical member, for example, one obtained by dividing a cylindrical member perpendicular to the bottom side thereof. The side dividing the cylindrical member may be a side containing the central shaft of the cylindrical member, or a side without containment thereof. In the present invention, a semi-cylindrical member is preferable, from the viewpoint of preventing generation of turbulence. One of examples of the impact member which can be used in the present invention are shown in FIGS. 4 (*a*) to (*h*). In FIG. 4, (*a*) to (*c*) are cylindrical impact members of which bottom is in the form of a part of a true circle or an oval especially preferably used in the present invention.

The sides at both ends of the impact side may be perpendicular to, slanted against, or smoothly curved to the impact side. It is preferable that the sides at both ends of the impact side are perpendicular to the impact side.

The materials for the impact member may be any of those that have wear resistance. The materials for the impact member include wear-resistant alloys, wear-resistant surface-treated metals, ceramics, and the like. Specifically, the materials include stellite alloy, Delchrome alloy, oxides such as alumina, titania, and zirconia, stainless steel, aluminum, iron, and the like, without being particularly limited thereto.

It is preferable that the impact member is arranged to face the outlet of the nozzle so that the line connecting 3 points for forming the circle $R_1$, and more preferably the most projected part on the line is located on the extension of the central shaft of the venturi nozzle. The closest distance between the outlet of the venturi nozzle and the impact member is preferably a distance such that a product to be pulverized is collided with the impact member and the pulverized product then smoothly flows in a rear direction, specifically from 3 d to 10 d. When the outlet of the venturi nozzle and the impact member are too close to each other, the flow of the product to be pulverized is disturbed, and when the outlet of the venturi nozzle and the impact member too far apart from each other, the impact energy is lowered.

Figure 5:
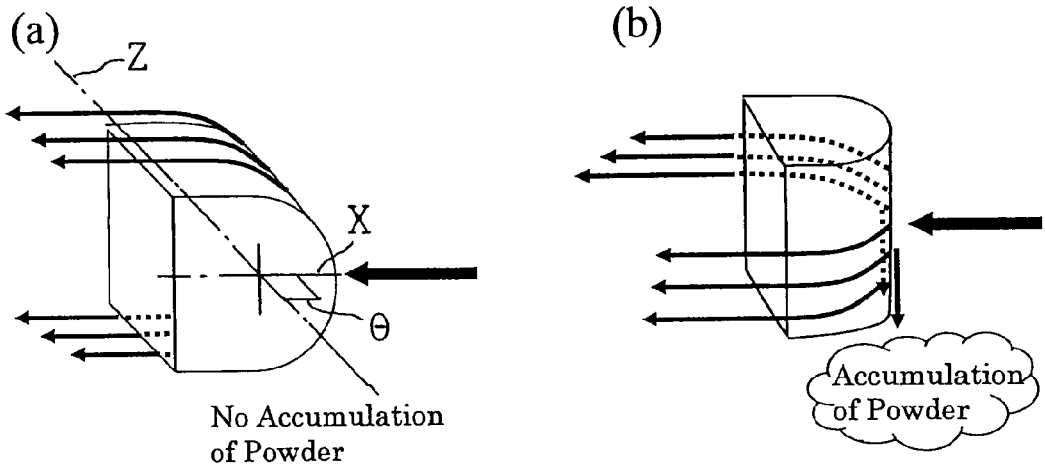
FIG. 5 is a schematic view showing one embodiment of an arrangement of an impact member used in the present invention to the direction of impact of a product to be pulverized.

The orientation of the impact member to be arranged is not particularly limited. When the direction of the impact of the product to be pulverized is parallel to a horizontal surface, it is preferable that the impact member is arranged in a widthwise direction (*a*) than a lengthwise direction (*b*), in order to prevent the lowering of the pulverization efficiency due to accumulation of the powder at the bottom of the impact member, as shown in FIG. 5. FIGS. 1 and 5*a* show an axis Z of the cylindrical impact member 2, and FIG. 5*a* shows an angle ⊖ between the axis Z and a longitudinal axis X of the venturi nozzle X. Arrows in FIG. 5 show a pathway before and after the impact of the product to be pulverized. In addition, if specified points are worn upon use and thereby the pulverization efficiency is lowered, the impact member in the present invention is shifted in the shaft direction, or rotated centering about the shaft, whereby a new impact line can also be provided. Further, it is preferable that the rim part of this impact member is provided with a pedestal in the form of a rectangular column, a cylinder, a cone, a quandrangular pyramid, or the like so as to circumvent the pulverized fine powder from being spread to the back part of the impact member.

After the pulverizing step, classifying steps are provided for excluding each of fine powder and coarse powder, thereby adjusting the particle size distribution of the toner. In the present invention, since the generation of the fine powder upon pulverization is reduced, a toner having a sharp particle size distribution can be obtained by even carrying out only the classifying step for excluding the coarse powder. In the classifying step, the coarse powder which has a large particle size and excluded may be again subjected to a pulverizer together with other resin composition. The classification method is not particularly limited, and the method can be carried out with a known classifier such as an air classifier.

The present invention more markedly exhibits its effect of reducing the fine powder in the preparation processes for a toner having a small particle size, having a volume-average particle size ($D_4$) of 7 μm or less, more preferably from 2 to 7 μm, even more preferably from 3 to 7 μm, and especially preferably from 4 to 6 μm, whereby a toner can be efficiently prepared.

EXAMPLES

[Softening Point]

A temperature at which a half of the resin flow out using a koka-type flow tester (CFT-500D, manufactured by Shimadzu Corporation) is referred to as a softening point (sample: 1 g, heating rate: 6° C./minute, load: 1.96 MPa, nozzle: 1 mm diameter×1 mm).

[Glass Transition Temperature]

The glass transition temperature is determined at a heating rate of 10° C./minute with a differential scanning calorimeter (DSC210, manufactured by Seiko Instruments, Inc.).

[Acid Value and Hydroxyl Value]

The acid value and the hydroxyl value are determined in accordance with the method of JIS K0070.

Preparation Example of Resin

A mixture of 350 g of polyoxypropylene(2.2)-2,2-bis(4-hydroxyphenyl)propane, 975 g of polyoxyethylene(2.2)-2,2-bis(4-hydroxyphenyl)propane, 299 g of terephthalic acid, 2 g of trimellitic acid, and 4 g of dibutyltin oxide was reacted at 230° C. under a nitrogen atmosphere until the softening point reached 113° C., to give a resin A in the form of a white solid. The resin A had a glass transition temperature of 66° C., a softening point of 113° C., an acid value of 6.0 mg KOH/g, and a hydroxyl value of 39.2 mg KOH/g.

Example 1

One-hundred parts by weight of the resin A, 4.5 parts by weight of a colorant "Permanent Carmine 3810" (manufactured by SANYO COLOR WORKS, LTD.), 7.0 parts by weight of a releasing agent "Carnauba Wax" (manufactured by Kato Yoko) and 2.0 parts by weight of a charge control agent "BONTRON P-51" (manufactured by Orient Chemical Co., Ltd.) were pre-mixed with a Henschel mixer, and thereafter the mixture was melt-kneaded with a twin-screw extruder.

The resulting melt-kneaded mixture was cooled, and roughly pulverized with a jet type pulverizer "Rotoplex" (manufactured by Hosokawa Micron Corporation) to a size of 0.1 to 3 mm or so. The amount 0.5 parts by weight of a hydrophobic silica "Aerosil R-972" (manufactured by Nippon Aerosil, average particle size: 16 nm) were added to 100 parts by weight of the pulverized resin composition, and mixed with a Henschel mixer at 1500 r/min for 1 minute while stirring.

The resulting mixture was fed at a feeding rate of 3.0 kg/h using an apparatus in which in the "Impact type Supersonic Jet Mill Model IDS2" (manufactured by Nippon Pneumatic Mfg. Co., Ltd., diameter of nozzle outlet: 9 mm), the impact member was replaced with an impact member as shown in FIG. 4(*a*) (material: ceramic, a semi-cylinder obtained by cutting a cylinder of which bottom has a true circle having a radius of 10 mm and a height of 40 mm, in a direction perpendicular to the bottom to halve the cylinder; $r_2/r_1=5/\infty=0$) (distance between the outlet of the venturi nozzle and the impact side of the impact member: 30 mm), and pulverized at a pulverization pressure of 0.5 Mp. Two sets of jet classifiers (Model DS, manufactured by Nippon Pneumatic Mfg. Co., Ltd.) were connected, and coarse powders having sizes of 8 μm or more were excluded by a two-step classification. The resulting upper limit cut-off classification powder had a volume-average particle size of 5.6 μm, a content of particles having sizes of 3 μm or less of 27.29% by number, and a content of particles having sizes of 4 μm or less of 50.87% by number.

The upper limit cut-off classification powder from which the coarse powders were excluded were further classified with a jet classifier (Model DS, manufactured by Nippon Pneumatic Mfg. Co., Ltd.) to exclude fine powders of 4 μm or less. The lower limit cut-off classification powder from which the fine powders were excluded had a volume-average particle size of 6.0 μm, a content of particles having sizes of 3 μm or less of 0.3% by number, and a content of particles having sizes of 4 μm or less of 2.1% by number. The yield against the mixture before pulverization was 65%.

Comparative Example 1

Figure 6:
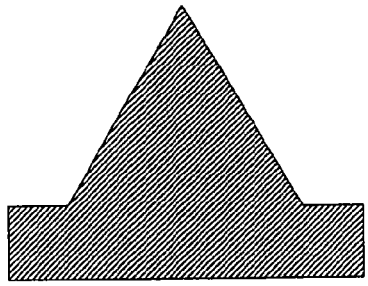
FIG. 6 is a schematic cross-sectional view of an impact member having a conical shaped impact side used in Comparative Example 1.

The same procedures as in Example 1 were carried out except that a conical impact side having a shape as shown FIG. 6 ($r_2/r_1$=17.5 mm/17.5 mm=1) was used as an impact member of "Impact type Supersonic Jet Mill Model IDS2" (manufactured by Nippon Pneumatic Mfg. Co., Ltd.), to give a toner.

An upper limit cut-off classification powder from which coarse powders having sizes of 8 μm or more were excluded had a volume-average particle size of 5.0 μm, a content of particles having sizes of 3 μm or less of 40.9% by number, and a content of particles having sizes of 4 μm or less of 66.0% by number. A lower limit cut-off classification powder had a volume-average particle size of 6.3 μm, a content of particles having sizes of 3 μm or less of 0.4% by number, and a content of particles having sizes of 4 μm or less of 2.0% by number. The yield against the mixture before pulverization was 30%.

It can be seen from the above results that in Example 1, the contents of particles having sizes of 3 μm or less and sizes of 4 μm or less are low, even though the upper limit cut-off classification powder from which the coarse powders are excluded has a volume-average particle size that does not differ significantly from that of Comparative Example 1, and finally Example 1 maintains a higher yield as compared to that of Comparative Example 1 even when a classified toner obtained by excluding coarse particles and fine powders and having the same volume-average particle size is obtained.

According to the present invention, the generation of fine powder upon pulverization of a resin composition can be efficiently reduced, whereby a toner, even a toner having a smaller particle size, can be efficiently prepared.

INDUSTRIAL APPLICABILITY

The toner obtained by the present invention is suitably used for developing a latent image formed in electrophotography, electrostatic recording method, electrostatic printing method, or the like.

The invention claimed is:

1. A process for preparing a toner comprising:

pulverizing a resin composition with a jet pulverizer including a venturi nozzle and an impact member arranged so as to face the venturi nozzle, wherein the impact member includes a cylindrical member of which an end is in a form of a part of a true circle or an oval, wherein the cylindrical member comprises an impact side on a curved side, and the impact side faces toward an inlet of the venturi nozzle, wherein an axis of the cylindrical member is disposed at a non-zero angle relative to a longitudinal axis of the venturi nozzle, wherein the axis of the cylindrical member is parallel to the impact side facing toward the inlet of the venturi nozzle, and wherein the axis of the cylindrical member is disposed horizontally with respect to gravity.

2. The process according to claim 1, wherein the impact member is arranged to face an outlet of the nozzle so that a most projected part is located on an extension of a central shaft of the venturi nozzle.

3. The process according to claim 1, wherein the venturi nozzle comprises an inlet, a throat part, a diffuser part, and an outlet in that order, wherein an inner side of said throat part forms a smooth, continuous arc starting from the inlet to the diffuser part.

4. The process according to claim 1, wherein the venturi nozzle comprises an inlet, a throat part, a diffuser part, a straight part, and an outlet in that order.

5. The process according to claim 1, wherein the resin composition is mixed with a fine inorganic particle, and thereafter the mixture is fed to the jet pulverizer.

6. The process according to claim 5, wherein the fine inorganic particle is made of silica.

7. The process according to claim 1, wherein the resin composition comprises a resin binder comprising at least one member selected from the group consisting of polyesters, vinyl resins such as styrene-acrylic resins, epoxy resins, polycarbonates, polyurethanes, and a hybrid resin in which two or more resin components are partially chemically bonded.

8. The process according to claim 1, wherein the resin composition is a resin composition having a particle size of 3 mm or less, obtained by melt-kneading a mixture comprising a resin binder and a colorant, and thereafter pulverizing the mixture.

9. The process according to claim 1, wherein the toner has a volume-average particle size of 7 μm or less.

10. The process according to claim 1, wherein the non-zero angle is a right-angle.

11. The process according to claim 1, wherein the direction of the impact of the product to be pulverized is parallel to a horizontal surface of the cylindrical member.

12. The process according to claim 1, wherein the axis of the cylindrical member is an axis of symmetry in at least one plane.

13. The process according to claim 1, wherein the venturi nozzle is the only nozzle the impact side faces.

14. A jet type pulverizer comprising:

a venturi nozzle; and an impact member arranged so as to face the venturi nozzle, wherein the impact member includes a cylindrical member of which bottom is in a form of a part of a true circle or an oval, wherein the cylindrical member comprises an impact side on a curved side and the impact side faces toward an inlet of the venturi nozzle, wherein an axis of the cylindrical member is disposed at a non-zero angle relative to a longitudinal axis of the venturi nozzle, wherein the axis of the cylindrical member is parallel to the impact side facing toward the inlet of the venturi nozzle, and wherein the axis of the cylindrical member is disposed horizontally with respect to gravity.

15. A process for preparing a toner comprising:

pulverizing a resin composition with a jet type pulverizer comprising a venturi nozzle and an impact member arranged so as to face the venturi nozzle, the resin composition flowing in a direction of travel toward the impact member, wherein the impact member includes a cylindrical member of which a bottom is in a form of a part of a true circle or an oval, wherein the cylindrical member comprises a curved impact side facing toward an inlet of the venturi nozzle, wherein a cross-sectional area of the cylindrical member including the curved impact side facing toward the inlet of the venturi nozzle is constant, and wherein the axis of the cylindrical member is disposed horizontally with respect to gravity.

16. The process according to claim 15, wherein a radius of curvature of the curved impact side is constant.

17. The process according to claim 15, wherein the cylindrical member includes first and second flat surfaces, and the first flat surface is disposed at first end of the cylindrical member opposite a second end of the cylindrical member on which the second flat surface is disposed.

18. The process according to claim 17, wherein the first and second flat surfaces are vertical.

19. The process according to claim 15, wherein the venturi nozzle is the only nozzle the impact side faces.

* * * * *